US010455861B2

(12) United States Patent
Lavanchy et al.

(10) Patent No.: US 10,455,861 B2
(45) **Date of Patent: *Oct. 29, 2019**

(54) AEROSOL GENERATING ARTICLE INCLUDING A HEAT-CONDUCTING ELEMENT AND A SURFACE TREATMENT

(71) Applicant: Philip Morris Products S.A., Neuchatel (CH)

(72) Inventors: Frederic Lavanchy, Chavornay (CH); Alexandre Malgat, Les Tuileries de Grandson (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

This patent is subject to a terminal disclaimer.

(21) Appl. No.: 16/108,925

(22) Filed: Aug. 22, 2018

(65) Prior Publication Data

US 2018/0360111 A1 Dec. 20, 2018

Related U.S. Application Data

(62) Division of application No. 15/544,724, filed as application No. PCT/EP2016/082351 on Dec. 22, 2016, now Pat. No. 10,117,459.

(30) Foreign Application Priority Data

Dec. 31, 2015 (EP) ..... 15203277

(51) Int. Cl.
*A24F 47/00* (2006.01)

(52) U.S. Cl.
CPC ..... *A24F 47/004* (2013.01); *A24F 47/006* (2013.01)

(58) Field of Classification Search
CPC ..... A24F 47/004
See application file for complete search history.

(56) References Cited

U.S. PATENT DOCUMENTS 9,357,803 B2 6/2016 Egoyants et al.
10,117,459 B2 * 11/2018 Lavanchy ..... A24F 47/006
(Continued)

FOREIGN PATENT DOCUMENTS

JP 2013-523094 A 6/2013
JP 2015-510399 A 4/2015
(Continued)

OTHER PUBLICATIONS

International Search Report and Written Opinion dated Mar. 23, 2017 in PCT/EP2016/082351, filed Dec. 22, 2016.
(Continued)

*Primary Examiner* — James Harvey
(74) *Attorney, Agent, or Firm* — Oblon, McClelland, Maier & Neustadt, L.L.P.

(57) ABSTRACT

There is provided an aerosol-generating article including a heat source; an aerosol-forming substrate disposed in thermal communication with the heat source; and a heat-conducting component disposed around at least a portion of the aerosol-forming substrate, the heat-conducting component including an outer surface forming at least part of an outer surface of the aerosol-generating article, wherein at least a portion of the outer surface of the heat-conducting component includes a surface coating and has an emissivity of less than about 0.6. A method of manufacturing the aerosol-generating article is also provided.

15 Claims, 6 Drawing Sheets

(56) References Cited

U.S. PATENT DOCUMENTS

| | | | | |
|---|---|---|---|---|
| 2009/0065011 | A1 | 3/2009 | Maeder et al. | |
| 2014/0166032 | A1* | 6/2014 | Gindrat ..... | A24B 3/14 131/353 |
| 2016/0316816 | A1 | 11/2016 | Lavanchy et al. | |
| 2017/0000189 | A1 | 1/2017 | Mironov et al. | |
| 2017/0055583 | A1 | 3/2017 | Blandino | |
| 2018/0007959 | A1 | 1/2018 | Lavanchy | |

FOREIGN PATENT DOCUMENTS

| | | | |
|---|---|---|---|
| KR | 10-2014-0132711 | A | 11/2014 |
| KR | 10-2015-0009544 | A | 1/2015 |
| KR | 10-2015-0099771 | A | 9/2015 |
| WO | WO 2009/022232 | A2 | 2/2009 |
| WO | WO 2015/097005 | A1 | 7/2015 |
| WO | WO 2015/101595 | A1 | 7/2015 |

OTHER PUBLICATIONS

Korean Notice of Allowance with English translation dated May 24, 2018 in corresponding Korean Patent Application No. 2017-7020455, citing documents AD and AR therein (3 pages).

Office Action dated Feb. 13, 2018 in Japanese in Patent Application No. 2017-539570 (with English language translation) citing documents AS and AT therein, 9 pages.

Office Action dated Jan. 18, 2018 in Korean Patent Application No. 10-2017-7020455 (with English language translation) citing references AU and AV therein, 10 pages.

* cited by examiner

AEROSOL GENERATING ARTICLE INCLUDING A HEAT-CONDUCTING ELEMENT AND A SURFACE TREATMENT

CROSS-REFERENCE TO RELATED APPLICATIONS

This application is a divisional application of and claims the benefit of priority under 35 U.S.C. § 120 from U.S. application Ser. No. 15/544,724, filed on Jul. 19, 2017, which is a U.S. national stage application under 35 U.S.C. § 371 of PCT/EP2016/082351, filed on Dec. 22, 2016, and claims the benefit of priority under 35 U.S.C. § 119 from EP Application No. 15 203277.7, filed on Dec. 31, 2015, the entire contents of each of which are incorporated herein by reference.

TECHNICAL FIELD

The present invention relates to an aerosol generating article comprising a heat source, an aerosol-forming substrate in thermal communication with the heat source and a heat-conducting component provided around at least a portion of the aerosol-forming substrate and comprising a surface coating. In some examples, the heat-conducting component comprises two or more heat-conducting elements.

DESCRIPTION OF THE RELATED ART

A number of smoking articles in which tobacco is heated rather than combusted have been proposed in the art. One aim of such 'heated' smoking articles is to reduce known harmful smoke constituents of the type produced by the combustion and pyrolytic degradation of tobacco in conventional cigarettes. In one known type of heated smoking article, an aerosol is generated by the transfer of heat from a combustible heat source to an aerosol-forming substrate located downstream of the combustible heat source. During smoking, volatile compounds are released from the aerosol-forming substrate by heat transfer from the combustible heat source and entrained in air drawn through the smoking article. As the released compounds cool, they condense to form an aerosol that is inhaled by the user. Typically, air is drawn into such known heated smoking articles through one or more airflow channels provided through the combustible heat source and heat transfer from the combustible heat source to the aerosol-forming substrate occurs by convection and conduction.

For example, WO-A-2009/022232 discloses a smoking article comprising a combustible heat source, an aerosol-forming substrate downstream of the combustible heat source, and a heat-conducting element around and in contact with a rear portion of the combustible heat source and an adjacent front portion of the aerosol-forming substrate.

The heat-conducting element in the smoking article of WO-A-2009/022232 transfers the heat generated during combustion of the heat source to the aerosol-forming substrate via conduction. The heat drain exerted by the conductive heat transfer significantly lowers the temperature of the rear portion of the combustible heat source so that the temperature of the rear portion is retained significantly below its self-ignition temperature.

In aerosol generating articles in which an aerosol-forming substrate is heated, for example smoking articles in which tobacco is heated, the temperature attained in the aerosol-forming substrate has a significant impact on the ability to generate a sensorially acceptable aerosol. It is typically desirable to maintain the temperature of the aerosol-forming substrate within a certain range in order to optimise the aerosol delivery to the user. In some cases, radiative heat losses from the outer surface of the heat-conducting element may cause the temperature of the combustible heat source or the aerosol-forming substrate to drop outside of the desired range, thereby impacting the performance of the smoking article. If the temperature of the aerosol-forming substrate drops too low, for instance, it may adversely impact the consistency and the amount of aerosol delivered to the user.

In certain heated aerosol generating articles, convective heat transfer from a combustible heat source to the aerosol-forming substrate is provided in addition to the conductive heat transfer. For example, in some known smoking articles at least one longitudinal airflow channel is provided through the combustible heat source in order to provide convective heating of the aerosol-forming substrate. In such smoking articles, the aerosol-forming substrate is heated by a combination of conductive and convective heating.

In other heated smoking articles it may be preferred to provide a combustible heat source without any airflow channels extending through the heat source. In such smoking articles, there may be limited convective heating of the aerosol-forming substrate and the heating of the aerosol-forming substrate is primarily achieved by the conductive heat transfer from the heat-conducting element. When the aerosol-forming substrate is heated primarily by conductive heat transfer, the temperature of the aerosol-forming substrate can become more sensitive to changes in the temperature of the heat-conducting element. This means that any cooling of the heat-conducting element due to radiative heat loss may have a greater impact on the aerosol generation than in smoking articles where convective heating of the aerosol-forming substrate is also available.

It would be desirable to provide a heated smoking article including a heat source and an aerosol-forming substrate downstream of the heat source which provides improved smoking performance. In particular, it would be desirable to provide a heated smoking article in which there is improved control of the conductive heating of the aerosol-forming substrate in order to help maintain the temperature of the aerosol-forming substrate within the desired temperature range during smoking.

It would also be desirable to provide a novel means for obtaining a desired external appearance of such smoking articles without compromising the internal temperature profile of the smoking article during use. For example, it may be desirable to provide a novel means for a consumer to distinguish between such smoking articles each comprising a different flavourant provided within the aerosol-forming substrate and delivered to the consumer during smoking.

SUMMARY

According to an aspect of the invention, there is provided an aerosol generating article comprising a combustible heat source. The article further comprises an aerosol-forming substrate in thermal communication with the combustible heat source. A heat-conducting component is around at least a portion of the aerosol-forming substrate, the heat-conducting component comprising an outer surface forming at least part of an outer surface of the aerosol generating article. At least a portion of the outer surface of the heat-conducting component comprises a surface coating and has an emissivity of less than about 0.6.

In some examples, it is preferred that the emissivity of the outer surface of the heat-conducting component is less than about 0.5. In some examples the emissivity may be less than about 0.4, less than about 0.3, less than about 0.2 or less than about 0.15. Preferably the emissivity is greater than about 0.1, greater than about 0.2, or greater than about 0.3.

Emissivity, which is a measure of the effectiveness of a surface in emitting energy as thermal radiation, is measured in accordance with ISO 18434-1, the details of which are set out herein in the Test Method for Emissivity section.

As used herein, the term 'aerosol-forming substrate' is used to describe a substrate capable of releasing, upon heating, volatile compounds, which can form an aerosol. The aerosol generated from aerosol-forming substrates may be visible or invisible and may include vapours (for example, fine particles of substances, which are in a gaseous state, that are ordinarily liquid or solid at room temperature) as well as gases and liquid droplets of condensed vapours.

By providing a surface coating on at least a portion of the heat-conducting component, it has been found that it is possible in some examples to manage the thermal properties of the aerosol generating article. In particular, in examples of the invention, the heat-conducting component can effect the transfer of heat from the combustible heat source. Heat transfer from the article through the heat conducting component and management of heat in the article can be effected by the presence of the surface coating.

The surface coating preferably comprises a filler or pigment material. The filler material may comprise an organic or inorganic material. Preferably the surface coating comprises an inorganic filler material. Preferably the filler material is heat stable to at least about 300 degrees Celsius or at least about 400 degrees Celsius. The filler material preferably comprises a pigment. Examples of filler material include graphite, metal carbonate and metal oxide. For example the filler material may comprise one or more metal oxides selected from titanium dioxide, aluminium oxide, and iron oxide. The filler may comprise calcium carbonate.

The heat conducting component may extend around and in contact with a downstream portion of the heat source. The heat-conducting component may comprise a first heat-conducting element around and in contact with a downstream portion of the heat source and an adjacent upstream portion of the aerosol-forming substrate, and a second heat-conducting element around at least a portion of the first heat-conducting element and comprising an outer surface forming at least part of an outer surface of the aerosol generating article. At least a portion of the outer surface of the second heat-conducting element comprises the surface coating and has an emissivity of less than 0.6.

BRIEF DESCRIPTION OF THE DRAWINGS

Embodiments will now be further described, by way of example only, with reference to the accompanying drawings in which.

DETAILED DESCRIPTION

Figure 1:
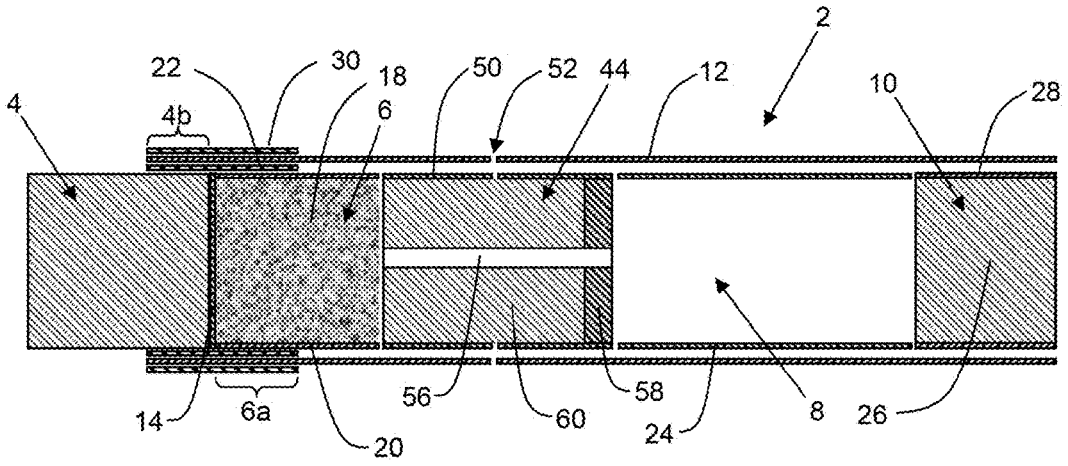
FIG. 1 shows a cross-sectional view of an aerosol generating article in accordance with the present invention.

The second heat-conducting element may be radially separated from the first heat-conducting element by at least one layer of a heat-insulating material extending around at least a portion of the first heat-conducting element between the first and second heat-conducting elements.

At least a portion of the outer surface of the heat-conducting component may comprise a surface treatment wherein the surface treatment preferably comprises at least one of embossing, debossing, and combinations thereof.

In examples of the invention, the aerosol forming substrate is downstream of the heat source.

According to a further aspect of the present invention there is provided an aerosol generating article comprising a heat source and an aerosol-forming substrate. The aerosol forming substrate may be downstream of the heat source. The aerosol generating article further comprises a heat-conducting component around and in contact with a downstream portion of the heat source and an adjacent upstream portion of the aerosol-forming substrate. The heat-conducting component comprises an outer surface forming at least a portion of an outer surface of the aerosol generating article. At least a portion of the outer surface of the heat-conducting component comprises a surface treatment, for example a surface coating, and has an emissivity of less than about 0.6.

In some examples, it is preferred that the emissivity of the outer surface of the heat-conducting component is less than about 0.5. In some examples the emissivity may be less than about 0.4, less than about 0.3, less than about 0.2 or less than about 0.15. Preferably the emissivity is greater than about 0.1, greater than about 0.2, or greater than about 0.3.

The heat-conducting component may comprise a first heat-conducting element around and in contact with the downstream portion of the heat source and the adjacent upstream portion of the aerosol-forming substrate, and a second heat-conducting element around at least a portion of the first heat-conducting element and comprising an outer surface forming at least part of an outer surface of the smoking article. At least a portion of the outer surface of the second heat-conducting element comprises the surface treatment and has an emissivity of less than about 0.6. The second heat-conducting element is preferably radially separated from the first heat-conducting element by at least one layer of a heat-insulating material extending around at least a portion of the first heat-conducting element between the first and second heat-conducting elements. That is, the second heat-conducting element might not directly contact the heat source or the aerosol-forming substrate in some examples.

As used herein, the terms "upstream" and "downstream" are used to describe the relative positions of elements, or portions of elements, of the aerosol generating article in relation to the direction in which a consumer draws on the aerosol generating article during use thereof. Aerosol generating articles as described herein comprise a downstream end (that is, the mouth end) and an opposed upstream end. In use, a consumer draws on the downstream end of the aerosol generating article. The downstream end is downstream of the upstream end, which may also be described as the distal end.

As used herein, the term "direct contact" is used to mean contact between two components without any intermediate connecting material, such that the surfaces of the components are touching each other.

As used herein, the term "radially separated" is used to indicate that at least a part of the second heat-conducting element is spaced apart from the underlying first heat-conducting element in a radial direction, such that there is no direct contact between that part of the second heat-conducting element and the first heat-conducting element.

The aerosol generating article of aspects of the present invention may incorporate a second heat-conducting element that overlies at least a portion of the first heat-conducting element. Preferably, there is radial separation between the first and second heat-conducting elements at one or more positions on the aerosol generating article.

Preferably, all or substantially all of the second heat-conducting element is radially separated from the first heat-conducting element by at least one layer of a heat-insulating material, such that there is substantially no direct contact between the first and second heat-conducting elements to limit or inhibit the conductive transfer of heat from the first heat-conducting element to the second heat-conducting element. As a result, the second heat-conducting element may retain a lower temperature than the first heat-conducting element. The radiative losses of heat from the outer surfaces of the aerosol generating article may be reduced compared to an aerosol generating article which does not have a second heat-conducting element around at least a portion of the first heat-conducting element.

The second heat-conducting element may advantageously reduce the heat losses from the first heat-conducting element. The second heat-conducting element may be formed of a heat conductive material which will increase in temperature during smoking of the aerosol generating article, as heat is generated by the heat source. The increased temperature of the second heat-conducting element may reduce the temperature differential between the first heat-conducting element and the overlying material such that the loss of heat from the first heat-conducting element can be managed, for example reduced.

By managing the heat losses from the first heat-conducting element, the second heat-conducting element may advantageously help to better maintain the temperature of the first heat-conducting element within the desired temperature range. The second heat-conducting element may advantageously help to more effectively use the heat from the heat source to warm the aerosol-forming substrate to the desired temperature range. In a further advantage, the second heat-conducting element may help maintain the temperature of the aerosol-forming substrate at a higher level. The second heat-conducting element may in turn improve the generation of aerosol from the aerosol-forming substrate. Advantageously, the second heat-conducting element may increase the overall delivery of aerosol to the user. In particular, in embodiments in which the aerosol-forming substrate comprises a nicotine source, it can be seen that the nicotine delivery can be significantly improved through the addition of the second heat-conducting element.

In addition, the second heat-conducting element has been found to advantageously extend the smoking duration for the aerosol generating article so that a greater number of puffs can be taken.

By providing the surface treatment on at least a portion of the heat-conducting component, for example on at least a portion of the second heat-conducting element, further management of the temperature of the aerosol generating article is possible.

The present inventors have also recognised that it is possible to provide a surface treatment on the outer surface of the heat-conducting component, for example on the second heat-conducting element, to provide a desired external appearance of the aerosol generating article, providing that the surface treatment maintains or provides an emissivity of less than about 0.6. Specifically, maintaining or providing an emissivity of less than about 0.6 on those portions of the heat-conducting component or second heat-conducting element on which the surface treatment is provided ensures that radiative heat losses from the aerosol generating article via the heat-conducting component or second heat-conducting element are managed.

The surface coating or other surface treatment may be provided on one or more portions of the outer surface of the heat-conducting component or second heat-conducting element. The surface coating or other surface treatment may be provided over substantially the whole of the outer surface of the heat-conducting component or second heat-conducting element.

The surface treatment may comprise at least one of embossing, debossing, and combinations thereof.

In both aspects of the invention, suitable surface coatings include coatings comprising at least one pigment that alters the perceived colour of the substrate forming the heat-conducting component or second heat-conducting element. For example, the coating may comprise a coloured ink.

Additionally, or alternatively, the surface coating may comprise a translucent material. The term "translucent" is used herein to mean a material that transmits at least about 20 percent of light incident upon the material for at least one wavelength of visible light, more preferably at least about 50 percent, most preferably at least about 80 percent. That is, for at least one wavelength of visible light, at least about 20 percent of the light incident upon a translucent material is not reflected or absorbed by the material, preferably at least about 50 percent, most preferably at least about 80 percent. The term "visible light" is used to refer to the visible portion of the electromagnetic spectrum between wavelengths of about 390 and about 750 nanometers.

Translucency is measured using the method according to ISO 2471. An opacity of less than about 80 percent indicates that the material is translucent. That is, for a material having an opacity of less than about 80 percent, at least about 20 percent of the light incident upon the material is not reflected or absorbed by the material. Therefore, translucent materials have an opacity of less than about 80 percent, preferably less than about 50 percent, most preferably less than about 20 percent.

The translucent material may transmit light evenly across the visible spectrum so that the translucent material has a colourless appearance. Alternatively, the translucent material may absorb at least 80 percent of incident light at one or more wavelengths so that the translucent material has a tinted or coloured appearance.

In any of those embodiments in which the surface coating comprises a translucent material, the translucent material may be a transparent material. Transparency is a special type of translucency and the term "transparent" is used herein to mean a translucent material that transmits light incident upon the material substantially without scattering. That is, light incident upon a transparent material is transmitted through the material in accordance with Snell's law. Transparent materials are a sub-set of translucent materials.

In addition to any of the surface coatings described herein, or as an alternative thereto, the surface coating may comprise at least one metallic material to provide a metallic appearance to the outer surface of the heat-conducting component or second heat-conducting element. For example, the surface coating may comprise metal particles, metal flakes, or both. The metallic material may comprise between about 10 percent and 100 percent of metal by weight, preferably between about 20 percent and about 50 percent metal by weight. In some embodiments the metallic material may be applied as a metallic ink.

In any of the embodiments described herein in which the surface treatment comprises a surface coating, the surface coating may consist of a single layer. For example, the surface coating may consist of a coloured or tinted transparent material. Alternatively, the surface coating may comprise multiple layers. In these embodiments, the multiple layers may be the same or different. Preferably, the multiple layers are different layers. For example, the surface coating may comprise a base layer comprising at least one of a pigment and a metallic material, and a transparent top layer overlying the base layer, all as described herein.

In any of the embodiments described herein in which the surface treatment comprises a surface coating, the outer surface of the surface coating preferably has a smooth surface that results in a high gloss effect. For example, in some embodiments the surface coating has a Parker-Print-Surface roughness of between about 0.1 micrometers and about 1 micrometer, preferably less than about 0.6 micrometers, measured according to ISO 8791-4.

The surface coating may be a substantially continuous coating on a portion of the heat-conducting component. In some examples, the surface coating is a discontinuous coating. For example the coating may include a plurality of separate regions of coating, for example an array of dots of coating. The proportion of the area covered by the coating may be different in one region of the coated portion to another region of the coated portion. The coating may comprise different coating materials in different regions of the heat-conducting component. One or more regions of the coating may have a textured surface. Thus, further management of the heat in the aerosol generating article may be possible.

In any of the embodiments described herein in which the surface treatment comprises a surface coating, the particular surface coating is selected to provide an emissivity at the outer surface of the heat-conducting component or second heat-conducting element of less than about 0.6. The present inventors have recognised that some coating materials may not be suitable for providing an emissivity value within this range. For example, some surface coatings comprising a significant quantity of a black pigment may exhibit an emissivity of significantly more than 0.6 and therefore result in an unacceptable level of radiative heat loss from the smoking article when applied to the outer surface of the heat-conducting component or second heat-conducting element. Therefore, coating materials and combinations of coating materials that result in an emissivity of greater than 0.6 do not fall within the scope of at least some aspects of the present invention. A skilled person can select suitable coating materials to provide an emissivity of less than about 0.6.

According to a further aspect of the invention, there is provided a method of manufacture of an aerosol generating article comprising a combustible heat source, an aerosol-forming substrate in thermal communication with the combustible heat source and a heat-conducting component around at least a portion of the aerosol-forming substrate, the heat-conducting component comprising an outer surface forming at least part of an outer surface of the aerosol generating article. The method includes the step of applying a coating composition to at least a portion of the outer surface of the heat-conducting component such that a coated portion of the heat-conducting component has an emissivity of less than about 0.6.

The coating composition may include a filler material, a binder and a solvent. The filler material may comprise one or more materials selected from graphite, metal oxides and metal carbonates. For example the filler material may comprise one or more metal oxides selected from titanium dioxide, aluminium oxide, and iron oxide. The filler may comprise calcium carbonate.

The binder may for example comprise nitrocellulose, ethyl cellulose, or cellulosic binder for example carboxy methyl cellulose or hydroxyl ethyl cellulose.

The solvent may for example comprise water or other solvent for example isopropanol.

An appropriate method may be used to apply the coating to the heat-conducting component before or after assembly of the heat-conducting component in the aerosol generating article. For example a printing technique may be used to apply the coating. A rotogravure technique may be used to apply the coating.

The amount of coating applied may be for example between about 0.5 and 2 $g/m^2$. The amount and thickness of the coating applied will be chosen for example to achieve the desired emissivity.

In any of the embodiments described herein, the heat-conducting component or each heat-conducting element may be formed from a metal foil such as, for example, an aluminium foil, a steel foil, an iron foil, a copper foil, or a metal alloy foil. Preferably, the heat conducting component or each heat-conducting element is formed from aluminium foil. The heat conducting component or each heat-conducting element may consist of a single layer of a heat-conducting material. Alternatively, the heat-conducting component or each heat-conducting element may comprise multiple layers of heat-conducting materials. In these embodiments, the multiple layers may comprise the same heat-conducting materials or different heat-conducting materials.

Preferably, the heat-conducting component or each heat-conducting element is formed from material having a bulk thermal conductivity of between about 10 Watts per meter Kelvin and about 500 Watts per meter Kelvin, more preferably between about 15 Watts per meter Kelvin and about 400 Watts per meter Kelvin, at 23 degrees Celsius and a relative humidity of 50 percent as measured using the modified transient plane source (MTPS) method.

Preferably the thickness of the heat-conducting component or each heat-conducting element is between about 5 micrometers and about 50 micrometers, more preferably between about 10 micrometers and about 30 micrometers and most preferably about 20 micrometers.

In those embodiments in which the heat-conducting component or second heat-conducting element is formed from a metal foil and the surface treatment comprises a surface coating, the surface coating may comprise a metal oxide layer. The metal oxide layer may be in addition to or an alternative to any of the surface coating materials described herein.

As described herein, the present inventors have recognised that maintaining or providing an emissivity of less than about 0.6 when applying a surface treatment to the outer surface of the heat-conducting component or second heat-conducting element optimises the thermal performance of the aerosol generating article by managing radiative thermal losses via the heat-conducting component or second heat-conducting element. The present inventors have further recognised that the effect of reducing radiative thermal losses may be particularly significant when the emissivity of the outer surface of the heat-conducting component or second heat-conducting element is less than about 0.5. Therefore, in any of the embodiments described herein, the portions of the outer surface of the heat-conducting component or second heat-conducting element comprising the surface treatment may have an emissivity of less than about 0.5, or less than about 0.4.

In accordance with a further aspect of the present invention there is provided an aerosol generating article comprising a heat source and an aerosol-forming substrate downstream of the heat source. The aerosol generating article further comprises a first heat-conducting element around and in contact with a downstream portion of the heat source and an adjacent upstream portion of the aerosol-forming substrate, and a second heat-conducting element around at least a portion of the first heat-conducting element and comprising an outer surface forming at least part of an outer surface of the aerosol generating article. The second heat-conducting element is radially separated from the first heat-conducting element by at least one layer of a heat-insulating material extending around at least a portion of the first heat-conducting element between the first and second heat-conducting elements. The outer surface of the second heat-conducting element may have an emissivity of less than about 0.6, and in some examples less than 0.5

The second heat-conducting element may be formed from a metal foil such as, for example, an aluminium foil, a steel foil, an iron foil, a copper foil, or a metal alloy foil. Preferably, the second heat-conducting element is formed from aluminium foil. The second heat-conducting element may consist of a single layer of a heat-conducting material. Alternatively, the second heat-conducting element may comprise multiple layers of heat-conducting materials. In these embodiments, the multiple layers may comprise the same heat-conducting materials or different heat-conducting materials.

Preferably, the second heat-conducting element is formed from material having a bulk thermal conductivity of between about 10 Watts per meter Kelvin and about 500 Watts per meter Kelvin, more preferably between about 15 Watts per meter Kelvin and about 400 Watts per meter Kelvin, at 23 degrees Celsius and a relative humidity of 50 percent as measured using the modified transient plane source (MTPS) method.

Preferably the thickness of the second heat-conducting element is between about 5 micrometers and about 50 micrometers, more preferably between about 10 micrometers and about 30 micrometers and most preferably about 20 micrometers.

According to aspects of the invention and in any of the embodiments described herein, the at least one layer of a heat-insulating material may comprise one or more layers of paper. The paper preferably provides complete separation of the first and second heat-conducting elements such that there is no direct contact between the surfaces of the heat-conducting elements.

Particularly preferably, the first and second heat-conducting elements are separated by a paper wrapper, which extends along the whole length of the aerosol generating article. In such embodiments, the paper wrapper is wrapped around the first heat-conducting element, and the second heat-conducting element is then applied on top of at least a portion of the paper wrapper.

The provision of the second heat-conducting element over the paper wrapper provides further benefits in relation to the appearance of the aerosol generating articles according to aspects of the invention, and in particular, the appearance of the aerosol generating article during and after smoking. In certain cases, some discolouration of the paper wrapper in the region of the heat source is observed when the wrapper is exposed to heat from the heat source. The paper wrapper may additionally be stained as a result of the migration of the aerosol former from the aerosol-forming substrate into the paper wrapper. In aerosol generating articles according to aspects of the invention, the second heat-conducting element can be provided over at least a part of the heat source and the adjacent part of the aerosol-forming substrate so that discolouration or staining is covered and no longer visible. The initial appearance of the aerosol generating article can therefore be retained during smoking.

Alternatively or in addition to an intermediate layer of paper between the first and second heat-conducting elements, at least a part of the first and second heat-conducting elements may be radially separated by an air gap so that the at least one layer of a heat-insulating material comprises the air gap. An air gap may be provided through the inclusion of one or more spacer elements between the first heat-conducting element and second heat-conducting element to maintain a defined separation from each other. This could be achieved, for example, through the perforation, embossment or debossment of the second heat-conducting element. In such embodiments, the embossed or debossed parts of the second heat-conducting element may be in contact with the first heat-conducting element whilst the non-embossed parts are separated from the first heat-conducting element by means of an air gap, or vice versa. Alternatively, one or more separate spacer elements could be provided between the heat-conducting elements.

Preferably, the first and second heat-conducting elements are radially separated from each other by at least 50 micrometers, more preferably by at least 75 micrometers and most preferably by at least 100 micrometers. Where one or more paper layers are provided between the heat-conducting elements, as described herein, the radial separation of the heat-conducting elements will be determined by the thickness of the one or more paper layers.

As described herein, the heat-conducting component or first heat-conducting element of aerosol generating articles according to aspects of the invention may be in contact with a downstream portion of the heat source and an adjacent upstream portion of the aerosol-forming substrate. In embodiments with a combustible heat source, the heat-conducting component or first heat-conducting element is preferably combustion resistant and oxygen restricting.

In particularly preferred embodiments of the invention, the heat-conducting component or first heat-conducting element forms a continuous sleeve that tightly circumscribes the downstream portion of the heat source and the upstream portion of the aerosol-forming substrate.

Preferably, the heat-conducting component or first heat-conducting element provides a substantially airtight connection between the heat source and the aerosol-forming substrate. This advantageously prevents combustion gases from the heat source being readily drawn into the aerosol-forming substrate through its periphery. Such a connection also minimises or substantially avoids convective heat transfer from the heat source to the aerosol-forming substrate by hot air drawn along the periphery.

The heat-conducting component or first heat-conducting element may be formed of any suitable heat-resistant material or combination of materials with an appropriate thermal conductivity. Preferably, the heat-conducting component or first heat-conducting element is formed from material having a bulk thermal conductivity of between about 10 Watts per meter Kelvin and about 500 Watts per meter Kelvin, more preferably between about 15 Watts per meter Kelvin and about 400 Watts per meter Kelvin, at 23 degrees Celsius and a relative humidity of 50 percent as measured using the modified transient plane source (MTPS) method.

Suitable heat-conducting components or first heat-conducting elements for use in smoking articles according to aspects of the invention include, but are not limited to: metal foil such as, for example, aluminium foil, steel foil, iron foil and copper foil; and metal alloy foil. The heat-conducting component or first heat-conducting element may consist of a single layer of a heat-conducting material. Alternatively, the heat-conducting component or first heat-conducting element may comprise multiple layers of heat-conducting materials. In these embodiments, the multiple layers may comprise the same heat-conducting materials or different heat-conducting materials.

The first heat-conducting element may be formed of the same material as the second heat-conducting element, or a different material. Preferably, the first and second heat-conducting elements are formed of the same material, which is most preferably aluminium foil.

Preferably the thickness of the first heat-conducting element is between about 5 micrometers and about 50 micrometers, more preferably between about 10 micrometers and about 30 micrometers and most preferably about 20 micrometers. The thickness of the first heat-conducting element may be substantially the same as the thickness of the second heat-conducting element, or the heat-conducting elements may have a different thickness to each other. Preferably, both the first and second heat-conducting elements are formed of an aluminium foil having a thickness of about 20 micrometers.

Preferably, the downstream portion of the heat source surrounded by the heat-conducting component or first heat-conducting element is between about 2 millimeters and about 8 millimeters in length, more preferably between about 3 millimeters and about 5 millimeters in length.

Preferably, the upstream portion of the heat source not surrounded by the heat-conducting component or first heat-conducting element is between about 5 millimeters and about 15 millimeters in length, more preferably between about 6 millimeters and about 8 millimeters in length.

Preferably, the aerosol-forming substrate extends at least about 3 millimeters downstream beyond the heat-conducting component or first heat-conducting element. In other embodiments, the aerosol-forming substrate may extend less than 3 millimeters downstream beyond the heat-conducting component or first heat-conducting element. In yet further embodiments, the entire length of the aerosol-forming substrate may be surrounded by the heat-conducting component or first heat-conducting element.

In certain preferred embodiments, the second heat-conducting element may be formed as a separate element. Alternatively, the second heat-conducting element may form part of a multilayer or laminate material, comprising the second heat-conducting element in combination with one or more heat-insulating layers. The layer forming the second heat-conducting element may be formed of any of the materials indicated herein. In certain embodiments, the second heat-conducting element may be formed as a laminate material including at least one heat-insulating layer laminated to the second heat-conducting element, wherein the heat-insulating layer forms an inner layer of the laminate material, adjacent the first heat-conducting element. In this way, the heat-insulating layer of the laminate provides the desired radial separation of the first heat-conducting element and the second heat-conducting element.

The use of a laminate material to provide the second heat-conducting element may additionally be beneficial during the production of the aerosol generating articles according to the invention, since the heat-insulating layer may provide added strength and rigidity. This enables the material to be processed more easily, with a reduced risk of collapse or breakage of the second heat-conducting element, which may be relatively thin and fragile.

One example of a particularly suitable laminate material for providing the second heat-conducting element is a double layer laminate, which includes an outer layer of aluminium and an inner layer of paper.

The position and coverage of the second heat-conducting element may be adjusted relative to the first heat-conducting element and the underlying heat source and aerosol-forming substrate in order to control heating of the smoking article during smoking. The second heat-conducting element may be positioned over at least a part of the aerosol-forming substrate. Alternatively or in addition, the second heat-conducting element may be positioned over at least a part of the heat source. More preferably, the second heat-conducting element is provided over both a part of the aerosol-forming substrate and a part of the heat source, in a similar way to the first heat-conducting element.

The extent of the second heat-conducting element in relation to the first heat-conducting element in the upstream and downstream directions may be adjusted depending on the desired performance of the aerosol generating article.

The second heat-conducting element may cover substantially the same area of the aerosol generating article as the first heat-conducting element so that the heat-conducting elements extend along the same length of the aerosol generating article. In this case, the second heat-conducting element preferably directly overlies the first heat-conducting element and fully covers the first heat-conducting element.

Alternatively, the second heat-conducting element may extend beyond the first heat-conducting element in the upstream direction, the downstream direction, or both the upstream and the downstream direction. Alternatively, or in addition, the first heat-conducting element may extend beyond the second heat-conducting element in at least one of the upstream and downstream direction.

Preferably, the second heat-conducting element does not extend beyond the first heat-conducting element in the upstream direction. The second heat-conducting element may extend to approximately the same position on the heat source as the first heat-conducting element, such that the first and second heat-conducting elements are substantially aligned over the heat source. Alternatively, the first heat-conducting element may extend beyond the second heat-conducting element in an upstream direction. This arrangement may reduce the temperature of the heat source.

Preferably, the second heat-conducting element extends to at least the same position as the first heat-conducting element in the downstream direction. The second heat-conducting element may extend to approximately the same position on the aerosol-forming substrate as the first heat-conducting element such that the first and second heat-conducting elements are substantially aligned over the aerosol-forming substrate. Alternatively, the second heat-conducting element may extend beyond the first heat-conducting element in the downstream direction so that the second heat-conducting element covers the aerosol-forming substrate over a larger proportion of its length than the first heat-conducting element. For example, the second heat-conducting element may extend by at least 1 millimeter beyond the first heat-conducting element, or at least 2 millimeters beyond the first heat-conducting element. Preferably however, the aerosol-forming substrate extends at least 2 millimeters downstream beyond the second heat-conducting element so that a downstream portion of the aerosol-forming substrate remains uncovered by both heat-conducting elements.

In aerosol generating articles according to all aspects of the invention, heat is generated through a heat source. The heat source may be, for example, a heat sink, a chemical heat source, a combustible heat source, or an electrical heat source. The heat source is preferably a combustible heat source, and comprises any suitable combustible fuel, including but not limited to carbon, aluminium, magnesium, carbides, nitrites and mixtures thereof.

Preferably, the heat source of aerosol generating articles according to the invention is a carbonaceous combustible heat source.

As used herein, the term "carbonaceous" is used to describe a heat source comprising carbon. Preferably, carbonaceous combustible heat sources according to the invention have a carbon content of at least about 35 percent, more preferably of at least about 40 percent, most preferably of at least about 45 percent by dry weight of the combustible heat source.

In some embodiments, the heat source of aerosol generating articles according to the invention is a combustible carbon-based heat source. As used herein, the term 'carbon-based heat source' is used to describe a heat source comprised primarily of carbon.

Combustible carbon-based heat sources for use in smoking articles according to the invention may have a carbon content of at least about 50 percent, preferably of at least about 60 percent, more preferably of at least about 70 percent, most preferably of at least about 80 percent by dry weight of the combustible carbon-based heat source.

Aerosol generating articles according to the invention may comprise combustible carbonaceous heat sources formed from one or more suitable carbon-containing materials.

If desired, one or more binders may be combined with the one or more carbon-containing materials. Preferably, the one or more binders are organic binders. Suitable known organic binders, include but are not limited to, gums (for example, guar gum), modified celluloses and cellulose derivatives (for example, methyl cellulose, carboxymethyl cellulose, hydroxypropyl cellulose and hydroxypropyl methylcellulose) flour, starches, sugars, vegetable oils and combinations thereof.

In one preferred embodiment, the combustible heat source is formed from a mixture of carbon powder, modified cellulose, flour and sugar.

Instead of, or in addition to one or more binders, combustible heat sources for use in smoking articles according to the invention may comprise one or more additives in order to improve the properties of the combustible heat source. Suitable additives include, but are not limited to, additives to promote consolidation of the combustible heat source (for example, sintering aids), additives to promote ignition of the combustible heat source (for example, oxidisers such as perchlorates, chlorates, nitrates, peroxides, permanganates, and/or zirconium), additives to promote combustion of the combustible heat source (for example, potassium and potassium salts, such as potassium citrate) and additives to promote decomposition of one or more gases produced by combustion of the combustible heat source (for example catalysts, such as CuO, $Fe_2O_3$ and $Al_2O_3$).

Combustible carbonaceous heat sources for use in aerosol generating articles according to the invention are preferably formed by mixing one or more carbon-containing materials with one or more binders and other additives, where included, and pre-forming the mixture into a desired shape. The mixture of one or more carbon containing materials, one or more binders and optional other additives may be pre-formed into a desired shape using any suitable known ceramic forming methods such as, for example, slip casting, extrusion, injection moulding and die compaction. In certain preferred embodiments, the mixture is pre-formed into a desired shape by extrusion.

Preferably, the mixture of one or more carbon-containing materials, one or more binders and other additives is pre-formed into an elongate rod. However, it will be appreciated that the mixture of one or more carbon-containing materials, one or more binders and other additives may be pre-formed into other desired shapes.

After formation, particularly after extrusion, the elongate rod or other desired shape is preferably dried to reduce its moisture content and then pyrolysed in a non-oxidizing atmosphere at a temperature sufficient to carbonise the one or more binders, where present, and substantially eliminate any volatiles in the elongate rod or other shape. The elongate rod or other desired shape is pyrolysed, preferably in a nitrogen atmosphere at a temperature of between about 700 degrees Celsius and about 900 degrees Celsius.

The combustible heat source preferably has a porosity of between about 20 percent and about 80 percent, more preferably of between about 20 percent and 60 percent. Even more preferably, the combustible heat source has a porosity of between about 50 percent and about 70 percent, more preferably of between about 50 percent and about 60 percent as measured by, for example, mercury porosimetry or helium pycnometry. The required porosity may be readily achieved during production of the combustible heat source using conventional methods and technology.

Advantageously, combustible carbonaceous heat sources for use in aerosol generating articles according to the invention have an apparent density of between about 0.6 grams per cubic centimeter and about 1 gram per cubic centimeter.

Preferably, the combustible heat source has a mass of between about 300 milligrams and about 500 milligrams, more preferably of between about 400 milligrams and about 450 milligrams.

Preferably, the combustible heat source has a length of between about 7 millimeters and about 17 millimeters, more preferably of between about 7 millimeters and about 15 millimeters, most preferably of between about 7 millimeters and about 13 millimeters.

Preferably, the combustible heat source has a diameter of between about 5 millimeters and about 9 millimeters, more preferably of between about 7 millimeters and about 8 millimeters.

Preferably, the combustible heat source is of substantially uniform diameter. However, the combustible heat source may alternatively be tapered so that the diameter of the rear portion of the combustible heat source is greater than the diameter of the front portion thereof. Particularly preferred are combustible heat sources that are substantially cylindrical. The combustible heat source may, for example, be a cylinder or tapered cylinder of substantially circular cross-section or a cylinder or tapered cylinder of substantially elliptical cross-section.

Aerosol generating articles according to the invention will include one or more airflow pathways along which air can be drawn through the aerosol generating article for inhalation by a user.

In certain embodiments of the invention, the heat source may comprise at least one longitudinal airflow channel, which provides one or more airflow pathways through the heat source. The term "airflow channel" is used herein to describe a channel extending along the length of the heat source through which air may be drawn through the aerosol generating article for inhalation by a user. Such heat sources including one or more longitudinal airflow channels are referred to herein as "non-blind" heat sources.

The diameter of the at least one longitudinal airflow channel may be between about 1.5 millimeters and about 3 millimeters, more preferably between about 2 millimeters and about 2.5 millimeters. The inner surface of the at least one longitudinal airflow channel may be partially or entirely coated, as described in more detail in WO-A-2009/022232.

In alternative embodiments of the invention, no longitudinal airflow channels are provided in the heat source so that air drawn through the aerosol generating article does not pass through any airflow channels along the heat source. Such heat sources are referred to herein as "blind" heat sources. Aerosol generating articles including blind heat sources define alternative airflow pathways through the smoking article.

In aerosol generating articles according to the invention comprising blind heat sources, heat transfer from the heat source to the aerosol-forming substrate occurs primarily by conduction and heating of the aerosol-forming substrate by convection is minimised or reduced. It is therefore particularly important with blind heat sources to optimise the conductive heat transfer between the heat source and the aerosol-forming substrate. The use of a second heat-conducting element has been found to have a particularly advantageous effect on the smoking performance of aerosol generating articles including blind heat sources, where there is little if any compensatory heating effect due to convection.

In aerosol generating articles according to the invention comprising blind heat sources, a non-combustible heat transfer element may be provided between the downstream end of the heat source and the upstream end of the aerosol-forming substrate. The heat transfer element may be formed from any of the heat-conducting materials described herein with reference to the first and second heat-conducting elements. Preferably, the heat transfer element is formed from a metal foil, most preferably aluminium foil. In addition to optimising conductive heat transfer from the heat source to the aerosol-forming substrate, the heat transfer element may also reduce or prevent migration of particles and gaseous combustion products from the heat source to the mouth end of the aerosol generating article.

Preferably, the aerosol-forming substrate comprises at least one aerosol-former and a material capable of emitting volatile compounds in response to heating.

The at least one aerosol former may be any suitable known compound or mixture of compounds that, in use, facilitates formation of a dense and stable aerosol. The aerosol former is preferably resistant to thermal degradation at the operating temperature of the aerosol generating article. Suitable aerosol-formers are well known in the art and include, for example, polyhydric alcohols, esters of polyhydric alcohols, such as glycerol mono-, di- or triacetate, and aliphatic esters of mono-, di- or polycarboxylic acids, such as dimethyl dodecanedioate and dimethyl tetradecanedioate. Preferred aerosol formers for use in aerosol generating articles according to the invention are polyhydric alcohols or mixtures thereof, such as triethylene glycol, 1,3-butanediol and, most preferred, glycerine.

Preferably, the material capable of emitting volatile compounds in response to heating is a charge of plant-based material, more preferably a charge of homogenised plant-based material. For example, the aerosol-forming substrate may comprise one or more materials derived from plants including, but not limited to: tobacco; tea, for example green tea; peppermint; laurel; *eucalyptus*; basil; sage; *verbena*; and tarragon. The plant based-material may comprise additives including, but not limited to, humectants, flavourants, binders and mixtures thereof. Preferably, the plant-based material consists essentially of tobacco material, most preferably homogenised tobacco material.

Preferably, the aerosol-forming substrate has a length of between about 5 millimeters and about 20 millimeters, more preferably of between about 8 millimeters and about 12 millimeters. Preferably, the front portion of the aerosol-forming substrate surrounded by the first heat-conducting element is between about 2 millimeters and about 10 millimeters in length, more preferably between about 3 millimeters and about 8 millimeters in length, most preferably between about 4 millimeters and about 6 millimeters in length. Preferably, the rear portion of the aerosol-forming substrate not surrounded by the first heat-conducting element is between about 3 millimeters and about 10 millimeters in length. In other words, the aerosol-forming substrate preferably extends between about 3 millimeters and about 10 millimeters downstream beyond the first heat-conducting element. More preferably, the aerosol-forming substrate extends at least about 4 millimeters downstream beyond the first heat-conducting element.

The heat source and aerosol-forming substrate of aerosol generating articles according to the invention may substantially abut one another. Alternatively, the heat source and aerosol-forming substrate of aerosol generating articles according to the invention may be longitudinally spaced apart from one another one another.

Preferably aerosol generating articles according to the invention comprise an airflow directing element downstream of the aerosol-forming substrate. The airflow directing element defines an airflow pathway through the aerosol generating article. At least one air inlet is preferably provided between a downstream end of the aerosol-forming substrate and a downstream end of the airflow directing element. The airflow directing element directs the air from the at least one inlet towards the mouth end of the aerosol generating article.

The airflow directing element may comprise an open-ended, substantially air impermeable hollow body. In such embodiments, the air drawn in through the at least one air inlet is first drawn upstream along the exterior portion of the open-ended, substantially air impermeable hollow body and then downstream through the interior of the open-ended, substantially air impermeable hollow body.

The substantially air impermeable hollow body may be formed from one or more suitable air impermeable materials that are substantially thermally stable at the temperature of the aerosol generated by the transfer of heat from the heat source to the aerosol-forming substrate. Suitable materials are known in the art and include, but are not limited to, cardboard, plastic, ceramic and combinations thereof.

In one preferred embodiment, the open-ended, substantially air impermeable hollow body is a cylinder, preferably a right circular cylinder.

In another preferred embodiment, the open-ended, substantially air impermeable hollow body is a truncated cone, preferably a truncated right circular cone.

The open-ended, substantially air impermeable hollow body may have a length of between about 7 millimeters and about 50 millimeters, for example a length of between about 10 millimeters and about 45 millimeters or between about 15 millimeters and about 30 millimeters. The airflow directing element may have other lengths depending upon the desired overall length of the aerosol generating article, and the presence and length of other components within the smoking article.

Where the open-ended, substantially air impermeable hollow body is a cylinder, the cylinder may have a diameter of between about 2 millimeters and about 5 millimeters, for example a diameter of between about 2.5 millimeters and about 4.5 millimeters. The cylinder may have other diameters depending on the desired overall diameter of the smoking article.

Where the open-ended, substantially air impermeable hollow body is a truncated cone, the upstream end of the truncated cone may have a diameter of between about 2 millimeters and about 5 millimeters, for example a diameter of between about 2.5 millimeters and about 4.5 millimeters. The upstream end of the truncated cone may have other diameters depending on the desired overall diameter of the aerosol generating article.

Where the open-ended, substantially air impermeable hollow body is a truncated cone, the downstream end of the truncated cone may have a diameter of between about 5 millimeters and about 9 millimeters, for example of between about 7 millimeters and about 8 millimeters. The downstream end of the truncated cone may have other diameters depending on the desired overall diameter of the aerosol generating article. Preferably, the downstream end of the truncated cone is of substantially the same diameter as the aerosol-forming substrate.

The open-ended, substantially air impermeable hollow body may abut the aerosol-forming substrate. Alternatively, the open-ended, substantially air impermeable hollow body may extend into the aerosol-forming substrate. For example, in certain embodiments the open-ended, substantially air impermeable hollow body may extend a distance of up to 0.5L into the aerosol-forming substrate, where L is the length of the aerosol-forming substrate.

The upstream end of the substantially air impermeable hollow body is of reduced diameter compared to the aerosol-forming substrate.

In certain embodiments, the downstream end of the substantially air impermeable hollow body is of reduced diameter compared to the aerosol-forming substrate.

In other embodiments, the downstream end of the substantially air impermeable hollow body is of substantially the same diameter as the aerosol-forming substrate.

Where the downstream end of the substantially air impermeable hollow body is of reduced diameter compared to the aerosol-forming substrate, the substantially air impermeable hollow body may be circumscribed by a substantially air impermeable seal. In such embodiments, the substantially air impermeable seal is located downstream of the one or more air inlets. The substantially air impermeable seal may be of substantially the same diameter as the aerosol-forming substrate. For example, in some embodiments the downstream end of the substantially air impermeable hollow body may be circumscribed by a substantially impermeable plug or washer of substantially the same diameter as the aerosol-forming substrate.

The substantially air impermeable seal may be formed from one or more suitable air impermeable materials that are substantially thermally stable at the temperature of the aerosol generated by the transfer of heat from the heat source to the aerosol-forming substrate. Suitable materials are known in the art and include, but are not limited to, cardboard, plastic, wax, silicone, ceramic and combinations thereof.

At least a portion of the length of the open-ended, substantially air impermeable hollow body may be circumscribed by an air permeable diffuser. The air permeable diffuser may be of substantially the same diameter as the aerosol-forming substrate. The air permeable diffuser may be formed from one or more suitable air permeable materials that are substantially thermally stable at the temperature of the aerosol generated by the transfer of heat from the heat source to the aerosol-forming substrate. Suitable air permeable materials are known in the art and include, but are not limited to, porous materials such as, for example, cellulose acetate tow, cotton, open-cell ceramic and polymer foams, tobacco material and combinations thereof.

In one preferred embodiment, the airflow directing element comprises an open ended, substantially air impermeable, hollow tube of reduced diameter compared to the aerosol-forming substrate and an annular, substantially air impermeable seal of substantially the same outer diameter as the aerosol-forming substrate, which circumscribes a downstream end of the hollow tube.

The airflow directing element may further comprise an inner wrapper, which circumscribes the hollow tube and the annular substantially air impermeable seal.

The open upstream end of the hollow tube may abut a downstream end of the aerosol-forming substrate. Alternatively, the open upstream end of the hollow tube may be inserted or otherwise extend into the downstream end of the aerosol-forming substrate.

The airflow directing element may further comprise an annular air permeable diffuser of substantially the same outer diameter as the aerosol-forming substrate, which circumscribes at least a portion of the length of the hollow tube upstream of the annular substantially air impermeable seal. For example, the hollow tube may be at least partially embedded in a plug of cellulose acetate tow.

In another preferred embodiment, the airflow directing element comprises: an open ended, substantially air impermeable, truncated hollow cone having an upstream end of reduced diameter compared to the aerosol-forming substrate and a downstream end of substantially the same diameter as the aerosol-forming substrate.

The open upstream end of the truncated hollow cone may abut a downstream end of the aerosol-forming substrate. Alternatively, the open upstream end of the truncated hollow cone may be inserted or otherwise extend into the downstream end of the aerosol-forming substrate.

The airflow directing element may further comprise an annular air permeable diffuser of substantially the same outer diameter as the aerosol-forming substrate, which circumscribes at least a portion of the length of the truncated hollow cone. For example, the truncated hollow cone may be at least partially embedded in a plug of cellulose acetate tow.

Aerosol generating articles according to the invention preferably further comprise an expansion chamber downstream of the aerosol-forming substrate and, where present, downstream of the airflow directing element. The inclusion of an expansion chamber advantageously allows further cooling of the aerosol generated by heat transfer from the heat source to the aerosol-forming substrate. The expansion chamber also advantageously allows the overall length of aerosol generating articles according to the invention to be adjusted to a desired value, for example to a length similar to that of conventional cigarettes, through an appropriate choice of the length of the expansion chamber. Preferably, the expansion chamber is an elongate hollow tube.

Aerosol generating articles according to the invention may also further comprise a mouthpiece downstream of the aerosol-forming substrate and, where present, downstream of the airflow directing element and expansion chamber. The mouthpiece may, for example, comprise a filter made of cellulose acetate, paper or other suitable known filtration materials. Preferably, the mouthpiece is of low filtration efficiency, more preferably of very low filtration efficiency. Alternatively or in addition, the mouthpiece may comprise one or more segments comprising absorbents, adsorbents, flavourants, and other aerosol modifiers and additives which are used in filters for conventional cigarettes, or combinations thereof.

Aerosol generating articles according to the invention may be assembled using known methods and machinery.

Test Method for Emissivity

Emissivity is measured in accordance with the test procedure set out in detail in ISO 18434-1. The test method uses a reference material of known emissivity to determine the unknown emissivity of a sample material. Specifically, the reference material is applied over a portion of the sample material and both materials are heated to a temperature of 100 degrees Celsius. The surface temperature of the reference material is then measured using an infrared camera and the camera system is calibrated using the known emissivity of the reference material. A suitable reference material is black polyvinyl chloride electrical insulation tape, such as Scotch® 33 Black Electrical Tape, which has an emissivity value of 0.95. Once the system has been calibrated using the reference material the infrared camera is repositioned to measure the surface temperature of the sample material. The emissivity value on the system is adjusted until the measured surface temperature of the sample material matches the actual surface temperature of the sample material, which is the same as the surface temperature of the reference material. The emissivity value at which the measured surface temperature matches the actual surface temperature is the true emissivity value for the sample material.

The aerosol generating article 2 shown in FIG. 1 comprises a combustible carbonaceous heat source 4, an aerosol-forming substrate 6, an airflow directing element 44, an elongate expansion chamber 8 and a mouthpiece 10 in abutting coaxial alignment. The combustible carbonaceous heat source 4, aerosol-forming substrate 6, airflow directing element 44, elongate expansion chamber 8 and mouthpiece 10 are overwrapped in an outer wrapper of cigarette paper 12 of low air permeability.

As shown in FIG. 1, a non-combustible, gas-resistant, first barrier coating 14 is provided on substantially the entire rear face of the combustible carbonaceous heat source 4. In an alternative embodiment, a non-combustible, substantially air impermeable first barrier is provided in the form of a disc that abuts the rear face of the combustible carbonaceous heat source 4 and the front face of the aerosol-forming substrate 6.

The combustible carbonaceous heat source 4 is a blind heat source so that air drawn through the aerosol generating article for inhalation by a user does not pass through any airflow channels along the combustible heat source 4.

The aerosol-forming substrate 6 is located immediately downstream of the combustible carbonaceous heat source 4 and comprises a cylindrical plug of tobacco material 18 comprising glycerine as an aerosol former and circumscribed by a filter plug wrap 20.

A heat-conducting component comprises a first heat-conducting element 22 consisting of a tube of aluminium foil surrounds and is in contact with a downstream portion 4*b* of the combustible carbonaceous heat source 4 and an abutting upstream portion 6*a* of the aerosol-forming substrate 6. As shown in FIG. 1, a downstream portion of the aerosol-forming substrate 6 is not surrounded by the first heat-conducting element 22.

An airflow directing element 44 is located downstream of the aerosol-forming substrate 6 and comprises an open-ended, substantially air impermeable hollow tube 56 made of, for example, cardboard, which is of reduced diameter compared to the aerosol-forming substrate 6. The upstream end of the open-ended hollow tube 56 abuts the aerosol-forming substrate 6. The downstream end of the open-ended hollow tube 56 is surrounded by an annular substantially air impermeable seal 58 of substantially the same diameter as the aerosol-forming substrate 6. The remainder of the open-ended hollow tube is embedded in a cylindrical plug of cellulose acetate tow 60 of substantially the same diameter as the aerosol-forming substrate 6.

The open-ended hollow tube 56 and cylindrical plug of cellulose acetate tow 60 are circumscribed by an air permeable inner wrapper 50. A circumferential row of air inlets 52 are provided in the outer wrapper 12 and the inner wrapper 50.

The elongate expansion chamber 8 is located downstream of the airflow directing element 44 and comprises a cylindrical open-ended tube of cardboard 24. The mouthpiece 10 of the aerosol generating article 2 is located downstream of the expansion chamber 8 and comprises a cylindrical plug of cellulose acetate tow 26 of very low filtration efficiency circumscribed by filter plug wrap 28. The mouthpiece 10 may be circumscribed by tipping paper (not shown).

The heat-conducting component further comprises a second heat-conducting element 30 consisting of a tube of aluminium foil surrounds and is in contact with the outer wrapper 12. The second heat-conducting element 30 is positioned over the first heat-conducting element 22 and is of the same dimensions as the first heat-conducting element 22. The second heat-conducting element 30 therefore directly overlies the first heat-conducting element 22, with the outer wrapper 12 between them. The outer surface of the second heat-conducting element 30 is coated with a surface coating, such as a glossy coloured coating, which yields an emissivity value of less than about 0.6, preferably less than about 0.2, for the outer surface of the second heat-conducting element 22.

In use, the user ignites the combustible carbonaceous heat source 4, which heats the aerosol-forming substrate 6 by conduction. The user then draws on the mouthpiece 10 so that cool air is drawn into the aerosol generating article 2 through the air inlets 52. The drawn air passes upstream between the exterior of the open-ended hollow tube 56 and the inner wrapper 50 through the cylindrical plug of cellulose acetate tow 60 to the aerosol-forming substrate 6. The heating of the aerosol-forming substrate 6 releases volatile and semi-volatile compounds and glycerine from the tobacco material 18, which are entrained in the drawn air as it reaches the aerosol-forming substrate 6. The drawn air is also heated as it passes through the heated aerosol-forming substrate 6. The heated drawn air and entrained compounds then pass downstream through the interior of the hollow tube 56 of the airflow directing element 44 to the expansion chamber 8, where they cool and condense. The cooled aerosol then passes downstream through the mouthpiece 10 of the aerosol generating article 2 into the mouth of the user.

The non-combustible, substantially air impermeable, barrier coating 14 provided on the entire rear face of the combustible carbonaceous heat source 4 isolates the combustible carbonaceous heat source 4 from the airflow pathways through the aerosol generating article 2 such that, in use, air drawn through the aerosol generating article 2 along the airflow pathways does not directly contact the combustible carbonaceous heat source 4.

The second heat-conducting element 30 retains heat within the aerosol generating article 2 to help maintain the temperature of the first heat-conducting element 22 during smoking. This in turn helps maintain the temperature of the aerosol-forming substrate 6 to facilitate continued and enhanced aerosol delivery.

Figure 2:
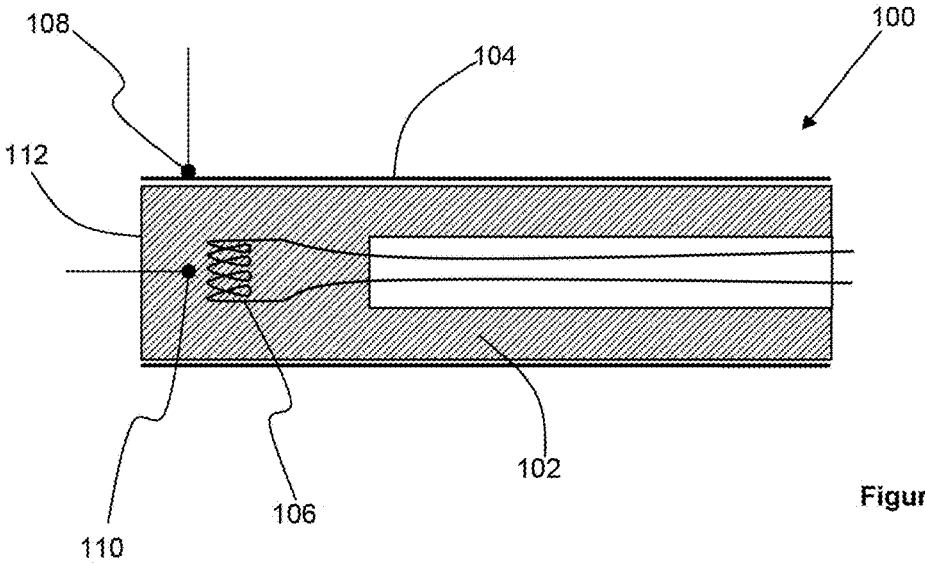
FIG. 2 shows a test apparatus for determining the effect of different second heat-conducting elements on thermal loss from an aerosol generating article.

FIG. 2 shows a test apparatus 100 for simulating the heating of an aerosol generating article in accordance with the present invention, which is used for testing the performance of different second heat-conducting elements, including those having different surface treatments. The test apparatus 100 comprises a cylindrical aluminium body 102 around which a test material 104 is wrapped. The test material 104 simulates a second heat-conducting element in an aerosol generating article according to the invention.

During the test, a coil heater 106 embedded within the aluminium body 102 simulates the heating effect of a combustible heat source at the upstream end of an aerosol generating article. To enable measurement of the emissivity of the outer surface of the test material 104 in accordance with ISO 18434-1, the voltage across the coil heater 106 is increased in stages to provide periods of stabilised elevated temperature during the heating process. Specifically, the voltage across the coil heater 106 is increased incrementally to 6 volts, 11 volts, 14 volts, 17 volts, 19.5 volts, 21 volts, and 24 volts, with a delay of 10 minutes between each voltage increase to allow the temperature of the test material 104 to stabilise.

During the test procedure, first and second thermocouples 108 and 110 record the temperature at the outer surface of the test material 104 and the interior of the aluminium body 102 respectively. Each thermocouple 108, 110 is positioned 7 millimeters from the upstream end 112 of the aluminium body 102.

Figure 3:
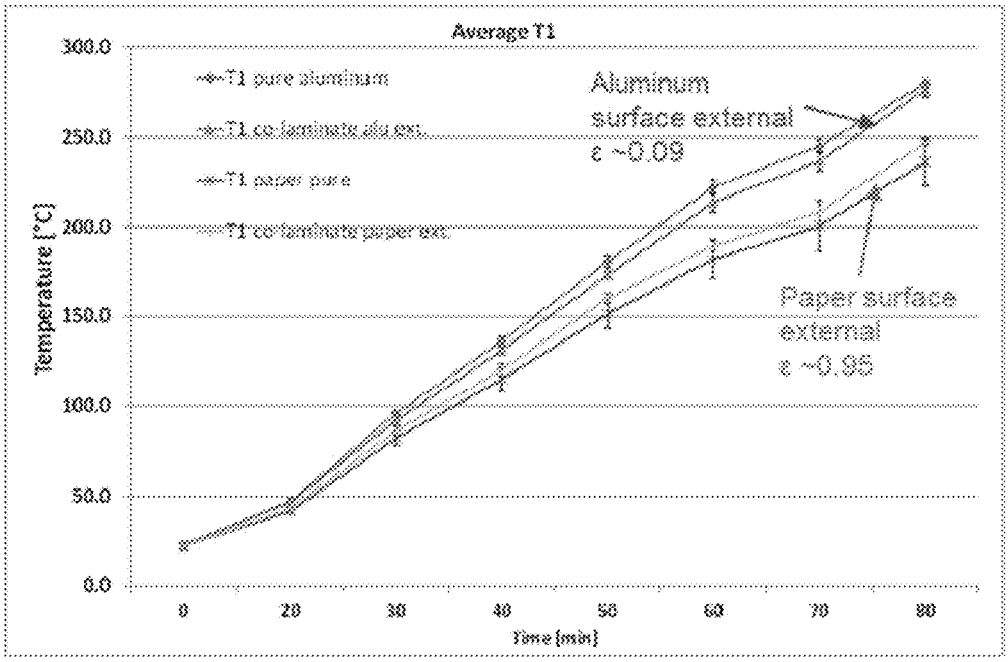
FIG. 3 shows a graph of outer surface temperature against time for different second heat-conducting element materials when tested on the apparatus of FIG. 2.

FIG. 3 shows a graph of surface temperature, measured using thermocouple 108, against time for different second heat-conducting element materials when tested on the apparatus of FIG. 2. The materials tested for the second heat-conducting element were: aluminium only; paper only; a paper-aluminium co-laminate with the aluminium layer forming the outer surface; and a paper-aluminium co-laminate with the paper layer forming the outer surface. The aluminium had a measured emissivity of 0.09 and the paper had a measured emissivity of 0.95. It is shown in FIG. 3 that the lower emissivity of the aluminium layer compared to the paper layer resulted in a higher outer surface temperature of the second heat-conducting element due to reduced radiative heat loss.

Figure 4:
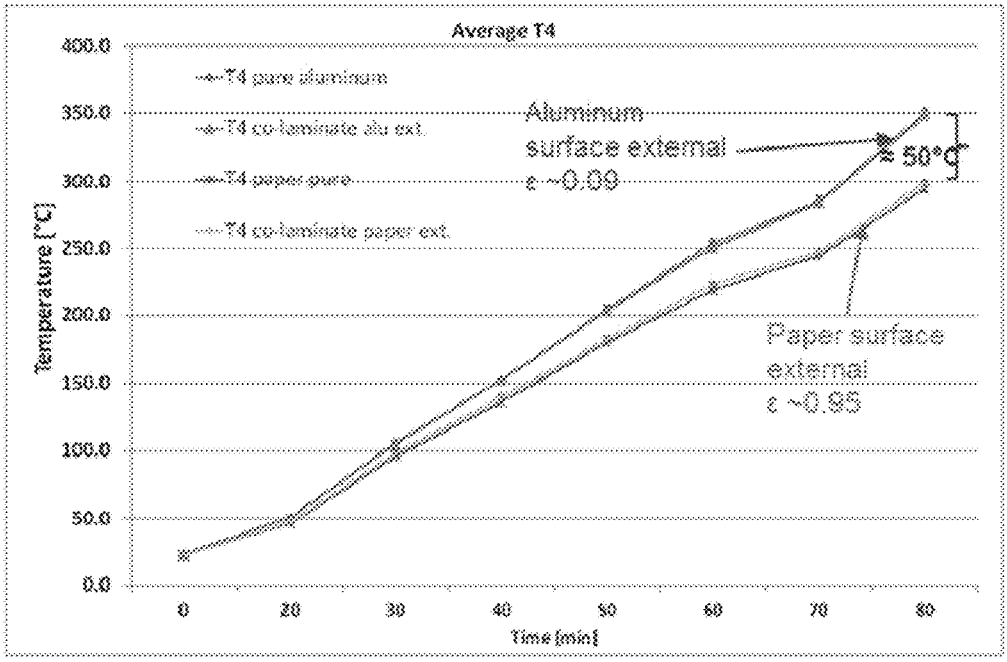
FIG. 4 shows a graph of internal temperature against time for different second heat-conducting element materials when tested on the apparatus of FIG. 2.

As shown in FIG. 4, which shows a graph of interior temperature against time, measured using thermocouple 110 during the same test as FIG. 3, the reduced radiative heat loss achieved by using a second heat-conducting element having a low emissivity at the outer surface also results in an increased internal temperature within the simulated aerosol generating article. Based on this data, the present inventors have recognised that utilising a second heat-conducting element having a low emissivity at its outer surface provides a more thermally efficient aerosol generating article and therefore a desirable increase in the internal temperature during smoking.

Figure 5:
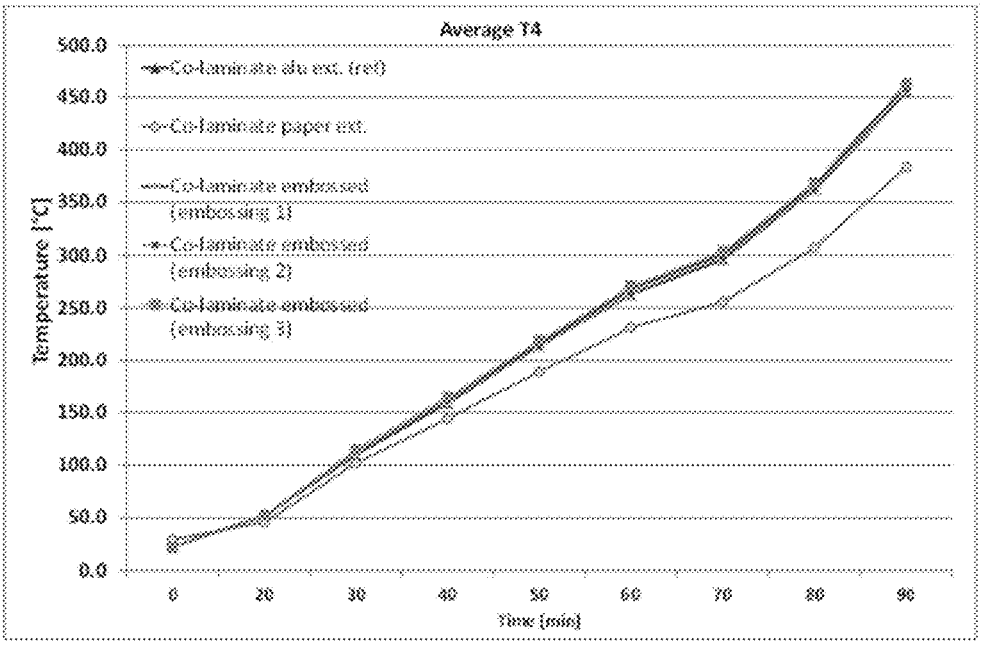
FIG. 5 shows a graph of internal temperature against time for second heat-conducting elements when tested on the apparatus of FIG. 2 to show the effect of different embossing patterns.

The heating test was repeated using three different paper-aluminium co-laminates each having a different embossment pattern, and in each case with the aluminium layer forming the outer surface of the second heat-conducting element. The test data is shown in FIG. 5, which shows the internal temperature measured with thermocouple 110 against time for all three test materials, as well as the data for the non-embossed co-laminate (for both aluminium and paper forming the outer surface) for reference. It is shown in the data in FIG. 5 that embossing the material forming the second heat conducting element has substantially no effect on the internal temperature of the simulated aerosol generating article during the heating test, which can be attributed to the embossing having substantially no effect on the emissivity at the outer surface of the second heat-conducting element. This is shown in the data in FIG. 7, which shows that the measured values of emissivity for the three embossing patterns were 0.092, 0.085 and 0.092, which are substantially the same as the emissivity value of 0.09 for the non-embossed co-laminate with the aluminium layer forming the outer surface.

Figure 6:
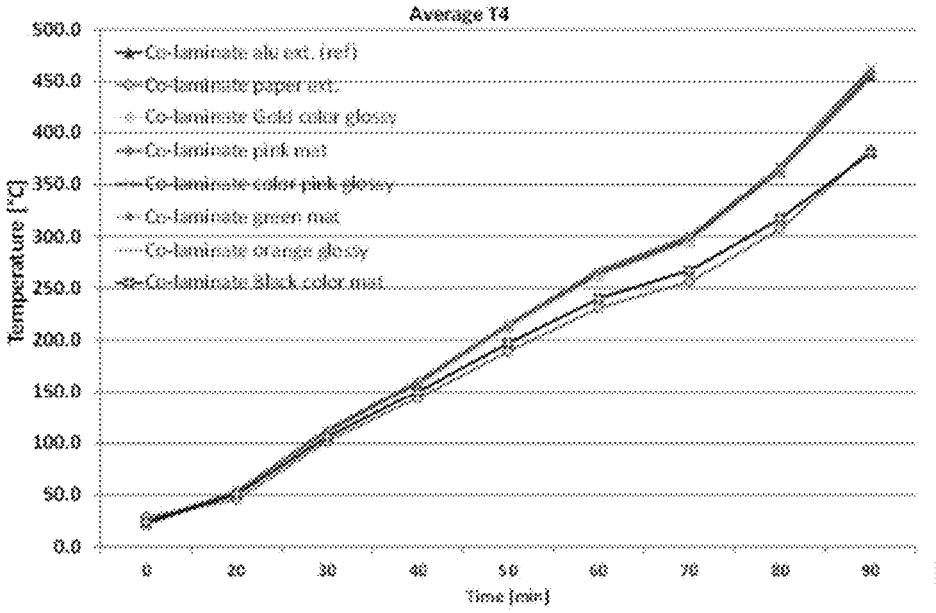
FIG. 6 shows a graph of internal temperature against time for second heat-conducting elements when tested on the apparatus of FIG. 2 to show the effect of different surface coatings.

The heating test was repeated again using six different paper-aluminium co-laminates each having a different surface coating of coloured ink applied over the outer surface of the aluminium layer, and in each case with the aluminium layer forming the outer surface of the second heat-conducting element. The six different surface coatings tested were: glossy gold colour; matt pink colour; glossy pink colour; matt green colour; glossy orange colour and matt black colour. The test data is shown in FIG. 6, which shows the internal temperature measured with thermocouple 110 against time for all six test materials, as well as the data for the non-coated co-laminate (for both aluminium and paper forming the outer surface) for reference. It is shown in FIG. 6 that coating the aluminium layer in a matt black ink resulted in an internal temperature during the test that was similar to that obtained with the paper layer of the co-laminate forming the outer surface of the second heat-conducting element. The other inks had no significant effect on the internal temperature of the simulated aerosol generating article when compared with the data for the uncoated aluminium layer forming the outer surface of the second heat-conducting element. Therefore, based on this data, the present inventors have recognised that applying a surface coating to the material forming the outer surface of the second heat-conducting element may have a significant effect on the thermal performance of the second heat-conducting element, depending on the particular surface coating used.

Figure 7:
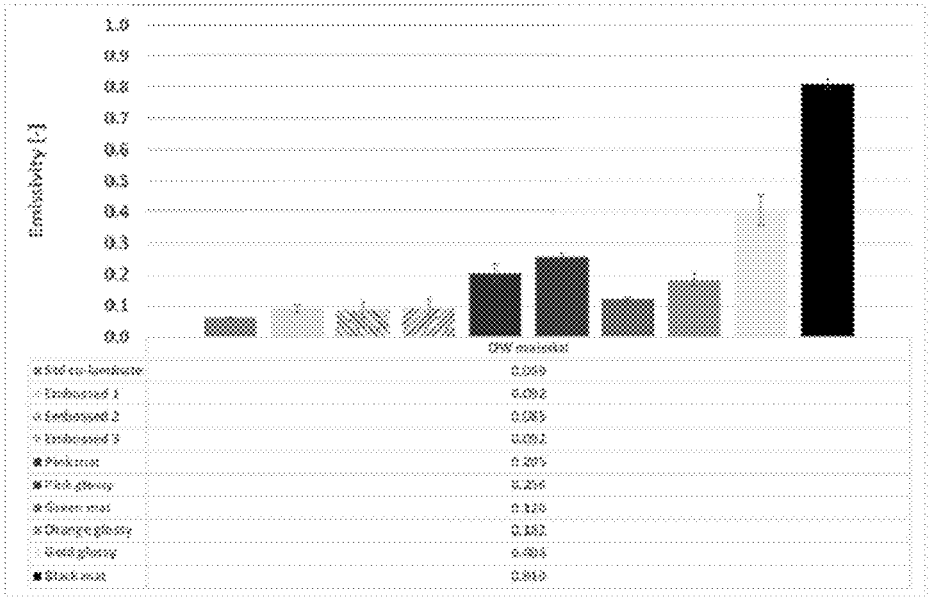
FIG. 7 shows a summary of the measured emissivity values for the different embossing patterns and the different surface coatings used in the tests of FIGS. 5 and 6.

In this regard, the emissivity of the different test materials used for the test in FIG. 6 was measured and the data is presented in FIG. 7. It is shown in FIG. 7 that, although applying a coloured coating to the aluminium layer increases the emissivity compared to the uncoated aluminium layer, the effect was most significant when the coating was a matt black colour. Accordingly, there is a direct correlation between the increase in the emissivity value as a result of applying a coloured coating and the resulting decrease in internal temperature of the simulated aerosol generating article during the heating test. Accordingly, the present inventors have recognised that, when applying a surface coating to the outer surface of the second heat-conducting element, the surface coating should be selected to maintain or provide a low emissivity value to prevent an undesirable reduction, or yield a desirable increase, in the internal temperature of the aerosol generating article during smoking.

Aerosol generating articles were constructed using the six coated co-laminates used for the tests in FIGS. 6 and 7, with the coated aluminium layer forming the outer surface of the second heat-conducting element in each case. For reference, an aerosol generating article was also constructed using a paper-aluminium co-laminate with an uncoated matt aluminium layer forming the outer surface of the second heat conducting element. In each case the co-laminate comprised a paper layer having a thickness of 73 micrometers and a basis weight of 45 grams per square meter laminated to an aluminium foil having a thickness of 6.3 micrometers. The aerosol generating articles were then smoked according to the Health Canada Intense smoking regime (55 cubic centimeters puff volume, 30 second puff frequency, 2 second puff duration) and the resulting data for delivery of glycerine, nicotine and total particulate matter (TPM) is shown in FIGS. 8 and 9.

Figure 8:
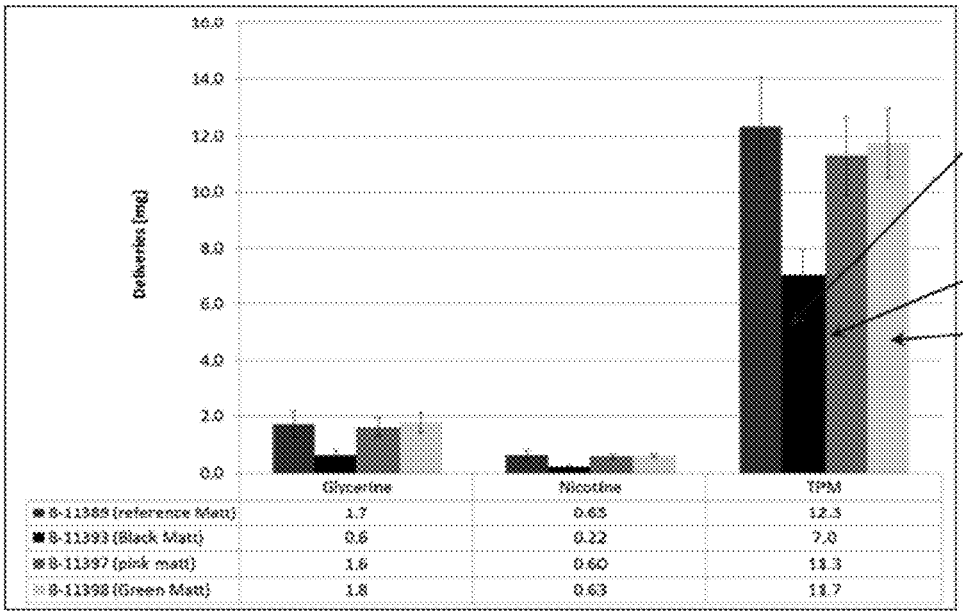
FIGS. 8 and 9 show test data for aerosol generating articles comprising second heat-conducting elements having the different surface coatings of FIG. 6 and smoked according to the Health Canada Intense smoking regime.
Figure 9:
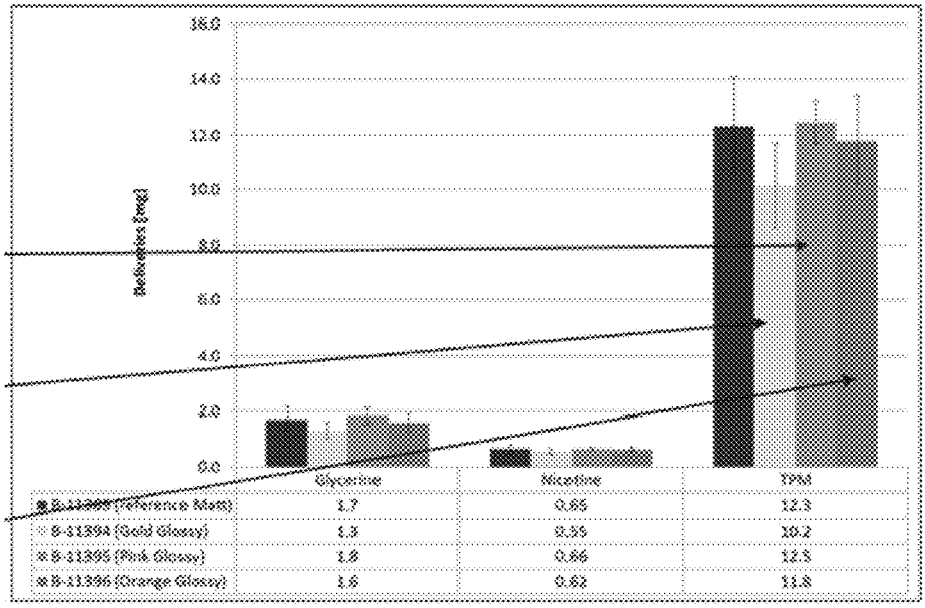

FIGS. 8 and 9 show that the matt pink, matt green, glossy pink and glossy orange coatings resulted in similar glycerine, nicotine and TPM delivery compared to the reference uncoated matt aluminium article. The glossy gold coating resulted in reduced but acceptable delivery compared to the reference article. The matt black coating resulted in a significantly reduced and unacceptable delivery compared to the reference article. Based on the data in FIGS. 8 and 9 combined with the measured emissivity values in FIG. 7, the present inventors have recognised that when providing a surface treatment on the outer surface of a material forming a second heat-conducting element the surface treatment should be selected to maintain or provide an emissivity of less than about 0.6.

Figure 10:
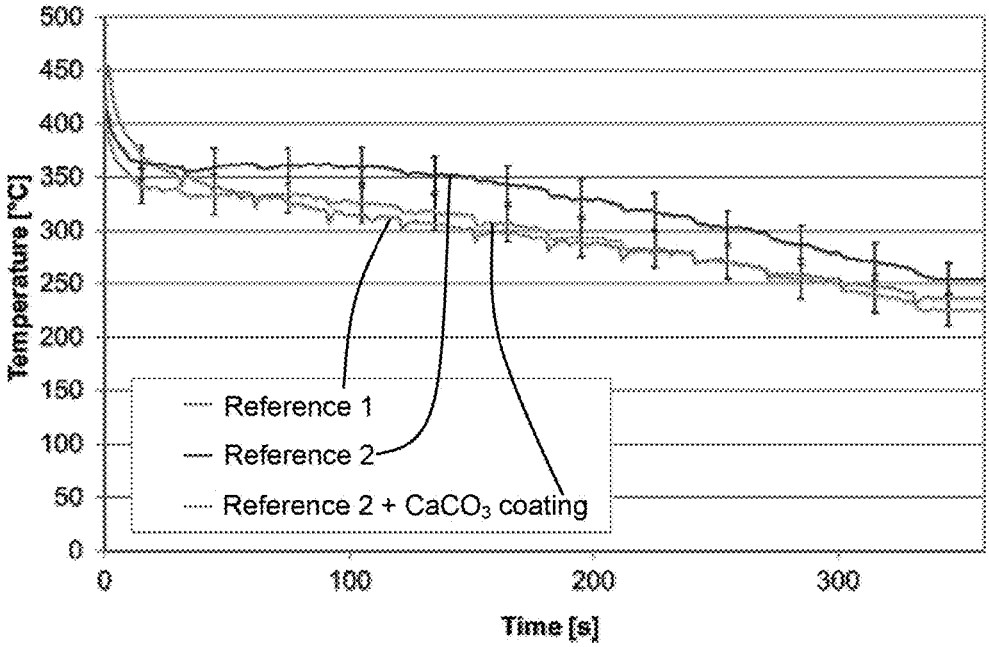
FIGS. 10 and 11 show comparative test data for aerosol generating articles comprising second heat-conducting elements having a surface coating of calcium carbonate and smoked according to the Health Canada Intense smoking regime.
Figure 11:
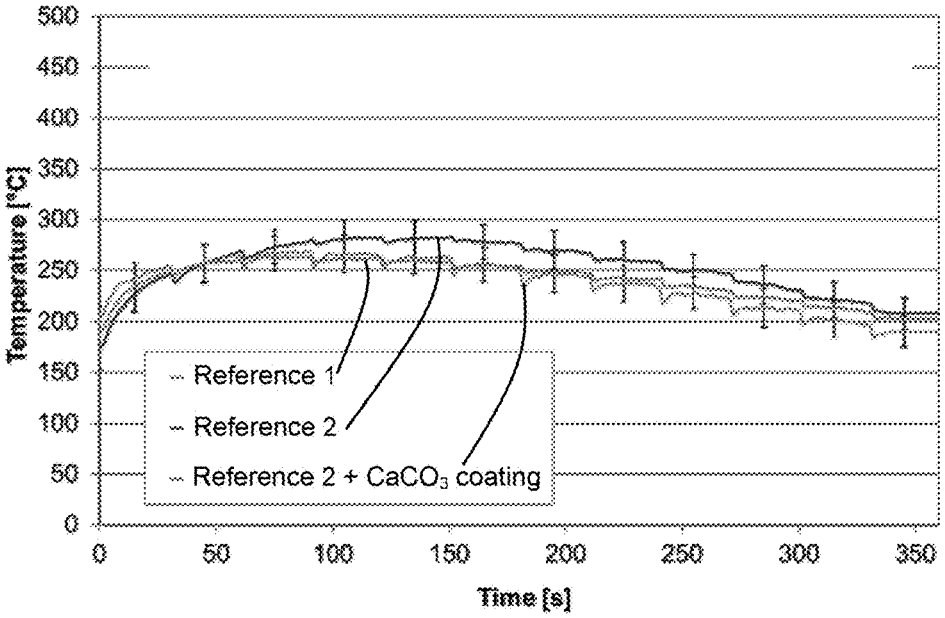

In a further example, aerosol-generating articles were constructed to examine the effect of a calcium carbonate coating on an outer surface of a second heat-conducting element. Sets of first and second reference articles were constructed, each having an uncoated second heat-conducting element, and then smoked according to the Health Canada Intense smoking regime (55 cubic centimeters puff volume, 30 second puff frequency, 2 second puff duration). The temperature profiles during smoking for the first and second reference articles are shown in FIGS. 10 and 11 (FIG. 10 shows temperature measured at the downstream end of the heat source, and FIG. 11 shows temperature measured at the upstream end of the aerosol-forming substrate). The second reference articles each include a heat source that provides a greater thermal output than the heat source of each of the first reference articles. As a result, the second reference articles exhibit a generally hotter temperature profile than the first reference articles.

For comparison, a set of third articles was constructed, each identical to the second reference articles except for the addition of a lacquer coating to the outer surface of the second heat-conducting elements, the lacquer comprising 60 percent calcium carbonate. The set of third articles was then smoked according to the same smoking regime and the results are shown in FIGS. 10 and 11. As shown in FIGS. 10 and 11, applying a calcium carbonate coating to the outer surface of the second heat-conducting elements of second reference articles modifies the temperature profiles of the second reference articles during smoking so that they approximate the temperature profiles of the first reference articles during smoking, despite the greater thermal output of the heat source in each second reference article compared to the thermal output of the heat source in each first reference article.

The embodiments and examples shown in FIGS. 1 to 11 and described herein illustrate but do not limit the invention. Other embodiments of the invention may be made without departing from the scope thereof, and it is to be understood that the specific embodiments described herein are not limiting.

The invention claimed is:

1. An aerosol generating article, comprising:

a heat source;

an aerosol-forming substrate disposed in thermal communication with the heat source; and a heat-conducting component disposed around at least a portion of the aerosol-forming substrate, the heat-conducting component comprising an outer surface forming at least part of an outer surface of the aerosol generating article, and wherein at least a portion of the outer surface of the heat-conducting component comprises a surface coating and has an emissivity of less than about 0.6.

2. The aerosol generating article according to claim 1, wherein the emissivity of the outer surface of the heat-conducting component is less than about 0.5.

3. The aerosol generating article according to claim 1, wherein the emissivity of the outer surface of the heat-conducting component is greater than about 0.1.

4. The aerosol generating article according to claim 1, wherein the surface coating comprises a filler material comprising one or more materials selected from graphite, metal oxides, and metal carbonates.

5. The aerosol generating article according to claim 1, wherein the surface coating is discontinuous.

6. The aerosol generating article according to claim 1, wherein the heat conducting component further comprises a first heat-conducting element disposed around and in contact with a downstream portion of the heat source and an adjacent upstream portion of the aerosol-forming substrate, and a second heat-conducting element disposed around at least a portion of the first heat-conducting element and comprising an outer surface forming at least part of an outer surface of the aerosol generating article.

7. The aerosol generating article according to claim 6, wherein the second heat-conducting element is radially separated from the first heat-conducting element by at least one layer of a heat-insulating material extending around at least a portion of the first heat-conducting element between the first and second heat-conducting elements.

8. The aerosol generating article according to claim 1, wherein at least a portion of the outer surface of the heat-conducting component comprises a surface treatment, and wherein the surface treatment comprises embossing, or debossing, or combinations thereof.

9. The aerosol generating article according to claim 1, wherein the surface coating comprises at least one pigment.

10. The aerosol generating article according to claim 1, wherein the surface coating comprises a translucent material.

11. The aerosol generating article according to claim 1, wherein the surface coating comprises metal particles, or metal flakes, or both.

12. The aerosol generating article according to claim 1, wherein the heat-conducting component comprises a metal foil.

13. A method of manufacture of an aerosol generating article comprising a heat source, an aerosol-forming substrate disposed in thermal communication with the heat source, and a heat-conducting component disposed around at least a portion of the aerosol-forming substrate, the heat-conducting component comprising an outer surface forming at least part of an outer surface of the aerosol generating article, the method including applying a coating composition to at least a portion of the outer surface of the heat-conducting component such that a coated portion of the heat-conducting component has an emissivity of less than about 0.6.

14. The method according to claim 13, wherein the coating composition includes a filler material, a binder, and a solvent.

15. The method according to claim 14, wherein the filler material comprises one or more materials selected from graphite, metal oxides, and metal carbonates.

* * * * *